US007254958B2

(12) United States Patent
Kim et al.

(10) Patent No.: US 7,254,958 B2
(45) Date of Patent: Aug. 14, 2007

(54) REFRIGERATOR

(75) Inventors: Hyun Bhum Kim, Gimhae-Si (KR); Dong Hoon Kim, Gwangju (KR)

(73) Assignee: Samsung Electronics Co., Ltd., Gyeonggi-do (KR)

( * ) Notice: Subject to any disclaimer, the term of this patent is extended or adjusted under 35 U.S.C. 154(b) by 191 days.

(21) Appl. No.: 11/196,429

(22) Filed: Aug. 4, 2005

(65) Prior Publication Data

US 2006/0150661 A1 Jul. 13, 2006

(30) Foreign Application Priority Data

Jan. 11, 2005 (KR) ..... 10-2005-0002623

(51) Int. Cl.

| | |
|---|---|
| ***F25D 23/02*** | (2006.01) |
| ***F25D 17/04*** | (2006.01) |
| ***A47B 97/00*** | (2006.01) |
| ***E06B 1/00*** | (2006.01) |

(52) U.S. Cl. ..... 62/265; 62/407; 312/292; 312/321.5

(58) Field of Classification Search ..... 62/265, 62/381, 407, 400, 440, 441, 447; 312/292, 312/291, 321.5, 404, 405

See application file for complete search history.

(56) References Cited

U.S. PATENT DOCUMENTS

| | | | | |
|---|---|---|---|---|
| 2,150,064 | A * | 3/1939 | Robert et al. | 62/266 |
| 2,281,430 | A * | 4/1942 | Grant | 312/292 |
| 2,470,956 | A * | 5/1949 | Savidge | 62/441 |
| 4,368,622 | A * | 1/1983 | Brooks | 62/157 |
| 4,586,347 | A | 5/1986 | McCarty | |
| 5,209,082 | A * | 5/1993 | Ha | 62/265 |
| 6,079,216 | A * | 6/2000 | de Marsillac Plunkett et al. | 62/56 |
| 7,059,693 | B2 * | 6/2006 | Park | 312/405.1 |
| 7,108,342 | B2 * | 9/2006 | Shin et al. | 312/405 |
| 2004/0178710 | A1 * | 9/2004 | Kim et al. | 312/405 |

FOREIGN PATENT DOCUMENTS

JP 9-229547 A * 9/1997

* cited by examiner

*Primary Examiner*—Mohammad M. Ali
(74) *Attorney, Agent, or Firm*—Sughrue Mion, PLLC

(57) ABSTRACT

A refrigerator is provided which selectively opens or closes an inner cover according to the closing or opening of an auxiliary door. The refrigerator includes a refrigerator door to open or close a refrigerator storage chamber, a door storage space provided at an inner side of the door, an access opening formed through the door to allow a user to take out items stored in the door storage space from the outside, the auxiliary door mounted at an outer side of the door to open or close the access opening, an inner cover mounted at the inner side of the door in an openable manner to separate the door storage space from the storage chamber, and an inner cover opening/closing device to close the inner cover when the auxiliary door is opened and to open the inner cover when the auxiliary door is closed.

6 Claims, 6 Drawing Sheets

REFRIGERATOR

CROSS-REFERENCE TO RELATED APPLICATION

This application claims the benefit of Korean Patent Application No. 2005-2623, filed on Jan. 11, 2005 in the Korean Intellectual Property Office, the disclosure of which is incorporated herein by reference.

BACKGROUND OF THE INVENTION

1. Field of the Invention

The present invention relates to a refrigerator, and more particularly, to a refrigerator that enables a smooth supply of cold air into a door storage space inside an auxiliary door.

2. Description of the Related Art

A refrigerator, as disclosed in U.S. Pat. No. 4,586,347, includes an access opening formed through a refrigerator door to allow a user to take out items stored in a storage space inside the door without opening the door, and an auxiliary door to open or close the access opening.

The auxiliary door is pivotally mounted at the bottom of the access opening formed through the refrigerator door to open or close the access opening through a vertical pivoting movement thereof. In the refrigerator of the type employing the auxiliary door, an intermediate storage space is provided inside the door to store certain food stuffs, such as beverages, to be taken out via the access opening. The intermediate storage space inside the door is separated from a storage chamber of the refrigerator by means of a separate inner cover to prevent cold refrigerated air of the storage chamber from leaking to the outside via the access opening when a user opens the auxiliary door. The inner cover is pivotally mounted at the top thereof to an inner side of the door. The inner cover is normally closed by gravity, and can be opened only when a user raises it by pivoting at the inner side of the door.

As a result of keeping the inner cover in a closed state when a user opens the auxiliary door, the above described refrigerator has the effect of preventing the cold refrigerated air within the storage chamber from leaking to the outside via the access opening. However, the inner cover is normally closed to separate the intermediate storage space from the storage chamber, and thus tends to hinder a smooth flow of the cold refrigerated air from the storage chamber into the intermediate storage space inside the door, thereby deteriorating a cooling efficiency of the intermediate storage space inside the door (i.e. a space inside the access opening).

SUMMARY OF THE INVENTION

Illustrative, non-limiting embodiments of the present invention overcome the above disadvantages, as well as other disadvantages not described above.

It is an aspect of the invention to provide a refrigerator in which an inner cover is closed when an auxiliary door is opened and conversely, is opened when the auxiliary door is closed, thereby preventing a leakage of cold refrigerated air to the outside and improving a cooling efficiency of an intermediate storage space inside a refrigerator door.

Additional aspects and/or advantages of the invention will be set forth in part in the description which follows and, in part, will be obvious from the description, or may be learned by practice of the invention.

An apparatus consistent with the present invention provides a refrigerator comprising a door to open or close a refrigerator storage chamber, a door storage space provided at an inner side of the door, an access opening formed through the door to allow a user to take out items stored in the door storage space from the outside of the refrigerator, an auxiliary door mounted at an outer side of the door to open or close the access opening, and an inner cover mounted at the inner side of the door in an openable manner to separate the door storage space from the storage chamber, further comprising: an inner cover opening/closing device to close the inner cover when the auxiliary door is opened and to open the inner cover when the auxiliary door is closed.

The inner cover may be pivotally mounted at an upper end thereof to the inner side of the door, and the inner cover opening/closing device may include an extension provided at the auxiliary door to extend toward the inner cover, the extension pushing and opening the inner cover when the auxiliary door is closed while causing the inner cover to be normally closed by gravity when the auxiliary door is opened.

A support may be provided at a pivot shaft of the inner cover to come into contact with the extension.

The inner cover may include a first inner cover member to open or close a lower region of the door storage space for the storage of items, and a second inner cover member to open or close an upper region of the door storage space to control a circulation of cold refrigerated air into the door storage space, the second inner cover member being opened or closed according to the closing or opening operation of the auxiliary door.

The inner cover opening/closing device may include a drive motor to open or close the inner cover and a sensor switch to sense whether the auxiliary door is opened or closed in order to control the opening or closing operation of the drive motor.

The inner cover may be pivotally coupled at an upper end thereof to the inner side of the door, and the drive motor is coupled to a pivot shaft of the inner cover to open or close the inner cover.

BRIEF DESCRIPTION OF THE DRAWINGS

These and/or other aspects and advantages of the exemplary embodiments of the invention will become apparent and more readily appreciated from the following description of the embodiments, taken in conjunction with the accompanying drawings, of which.

DETAILED DESCRIPTION OF THE PREFERRED EMBODIMENTS

Figure 1:
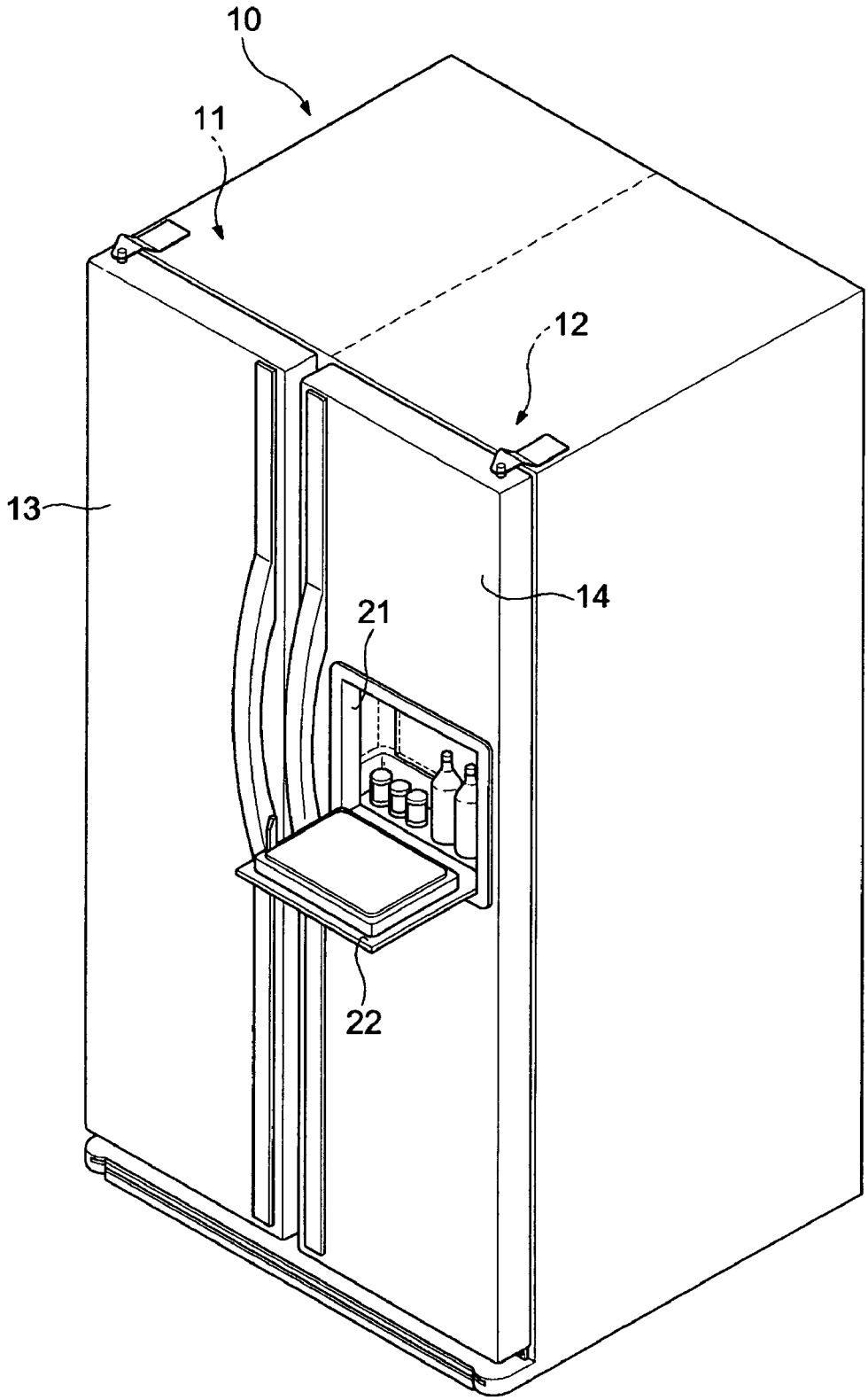
FIG. 1 is a perspective view showing the general appearance of a refrigerator consistent with the present invention.

Reference will now be made in detail to exemplary embodiments of the present invention, examples of which are illustrated in the accompanying drawings, wherein like reference numerals refer to like elements throughout. The embodiments are described below to explain the present invention by referring to the figures.

FIG. 1 is a perspective view showing the general appearance of a refrigerator consistent with the present invention.

Referring to FIG. 1, there is shown a refrigerator body 10 including an interior storage chamber divided into a freezing chamber 11 and a refrigerating chamber 12 arranged in side-by-side configuration. To independently open or close the freezing chamber 11 and the refrigerating chamber 12, a freezing chamber door 13 and a refrigerating chamber door 14 are mounted at front sides of the freezing chamber 11 and the refrigerating chamber 12, respectively.

Figure 2:
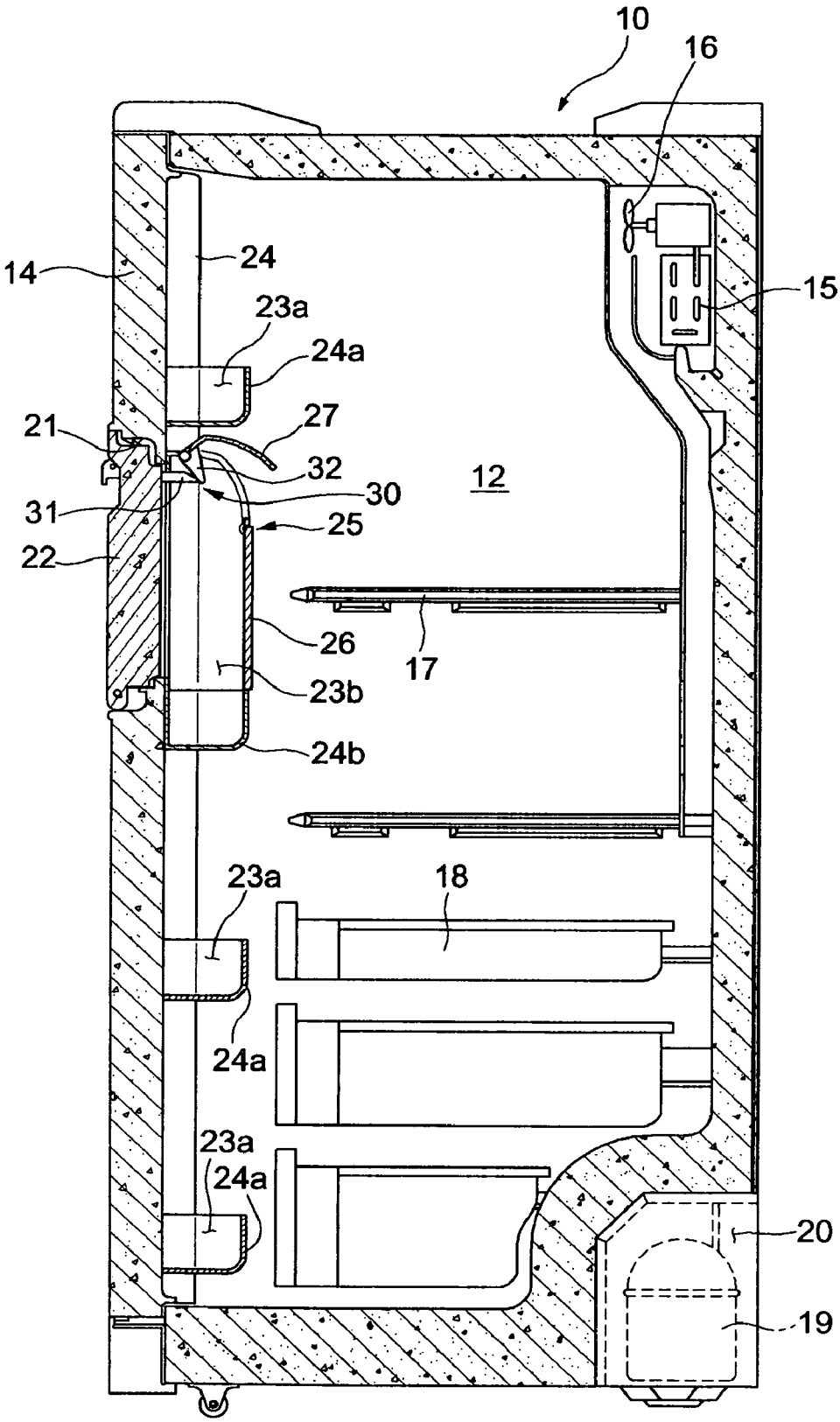
FIG. 2 is a vertical sectional view showing a storage chamber of the refrigerator of FIG. 1.

FIG. 2 is a vertical sectional view showing the storage chamber of the refrigerator, more particularly, the refrigerating chamber 12.

As shown in FIG. 2, a refrigerating chamber evaporator 15 and cold air circulating fan 16 are mounted in a rear upper region of the refrigerating chamber 12 to circulate cold refrigerated air within the refrigerating chamber 12. A plurality of shelves 17 and drawers 18 are vertically arranged in the refrigerating chamber 12 for the storage of various items. A machine room 20 is provided in the rear lower portion of the body 10 to contain a compressor 19, etc. The machine room 20 is separated from both the refrigerating chamber 12 and the freezing chamber 11 located thereabove.

Referring to FIGS. 1 and 2, the refrigerating chamber door 14 (hereinafter, referred to as "door") has an access opening 21 formed therethrough to allow a user to take out items stored in the refrigerating chamber 12 without opening the door 14. An auxiliary door 22 is pivotally mounted at a lower end thereof to the bottom of the access opening 21 to open or close the access opening 21 through a vertical pivoting motion thereof.

A plurality of door baskets 24*a* and 24*b*, as shown in FIG. 2, are mounted at an inner side of the door 14 to gain a plurality of door storage spaces 23*a* and 23*b* for the storage of certain food stuffs, such as beverages, butter or cheese. As will be more easily appreciated from FIGS. 3 and 4, the door storage space 23*b* inside the access opening 21 is separated from the remaining interior space of the refrigerating chamber 12 by means of a refreshment case 25, in order to prevent a leakage of cold refrigerated air from the refrigerating chamber 12 when a user opens the auxiliary door 22. The refreshment case 25 has a lower first inner cover 26 and an upper second inner cover 27 to open or close the door storage space 23*b*. The first inner cover 26 is used to open the door storage space 23*b* from the inner side of the door 14 in order to allow a user to put items into the door storage space 23*b*. The second inner cover 27 serves to control inflow of the cold refrigerated air from the refrigerating chamber 12 into the door storage space 23*b*. The first and second inner covers 26 and 27 are pivotally mounted at their upper ends to the refreshment case 25 to be closed by gravity.

Figure 3:
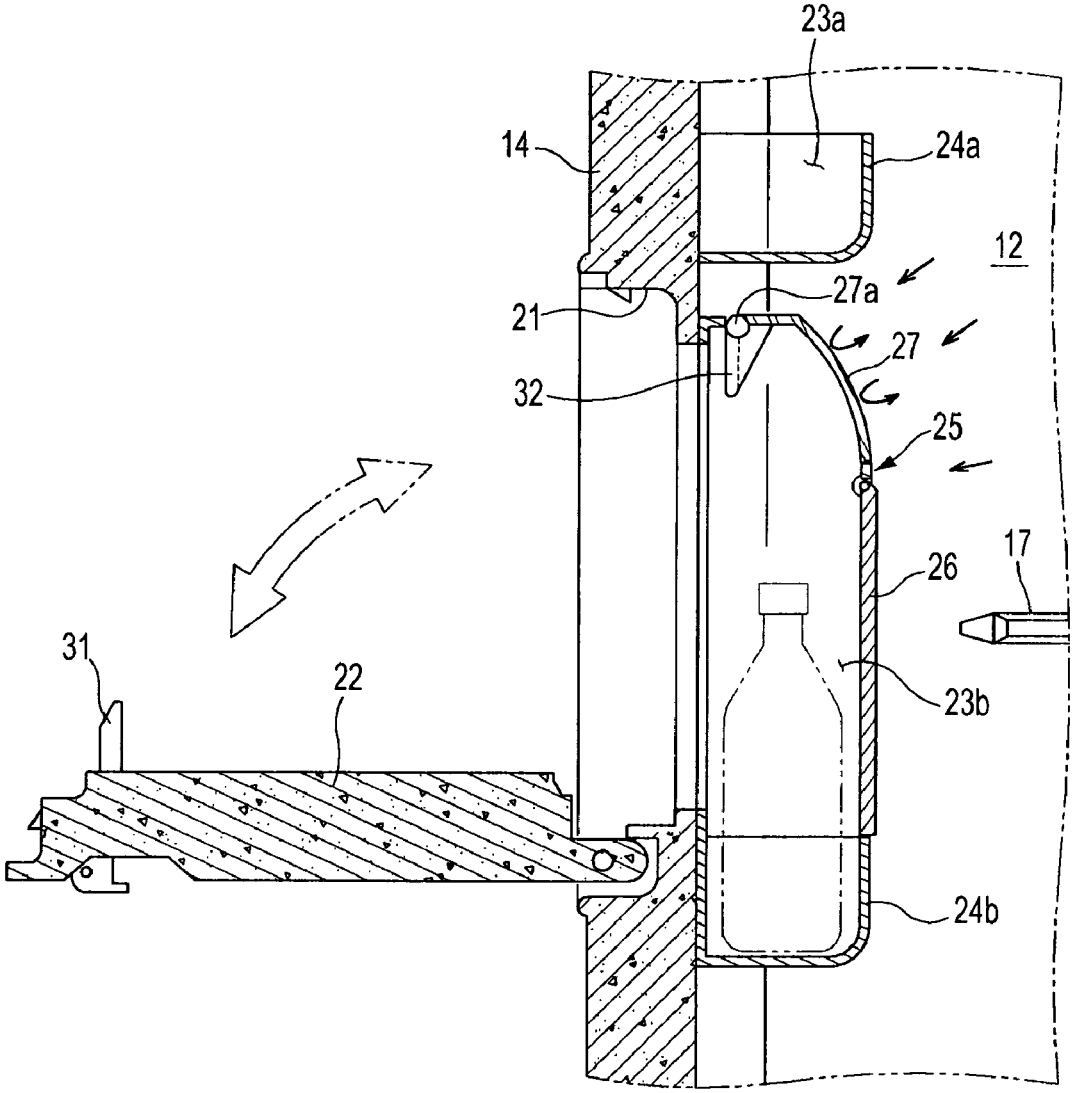
FIG. 3 is a vertical sectional view showing an inner cover opening/closing device of the refrigerator consistent with a first exemplary embodiment of the present invention, in an opened state of an auxiliary door.
Figure 4:
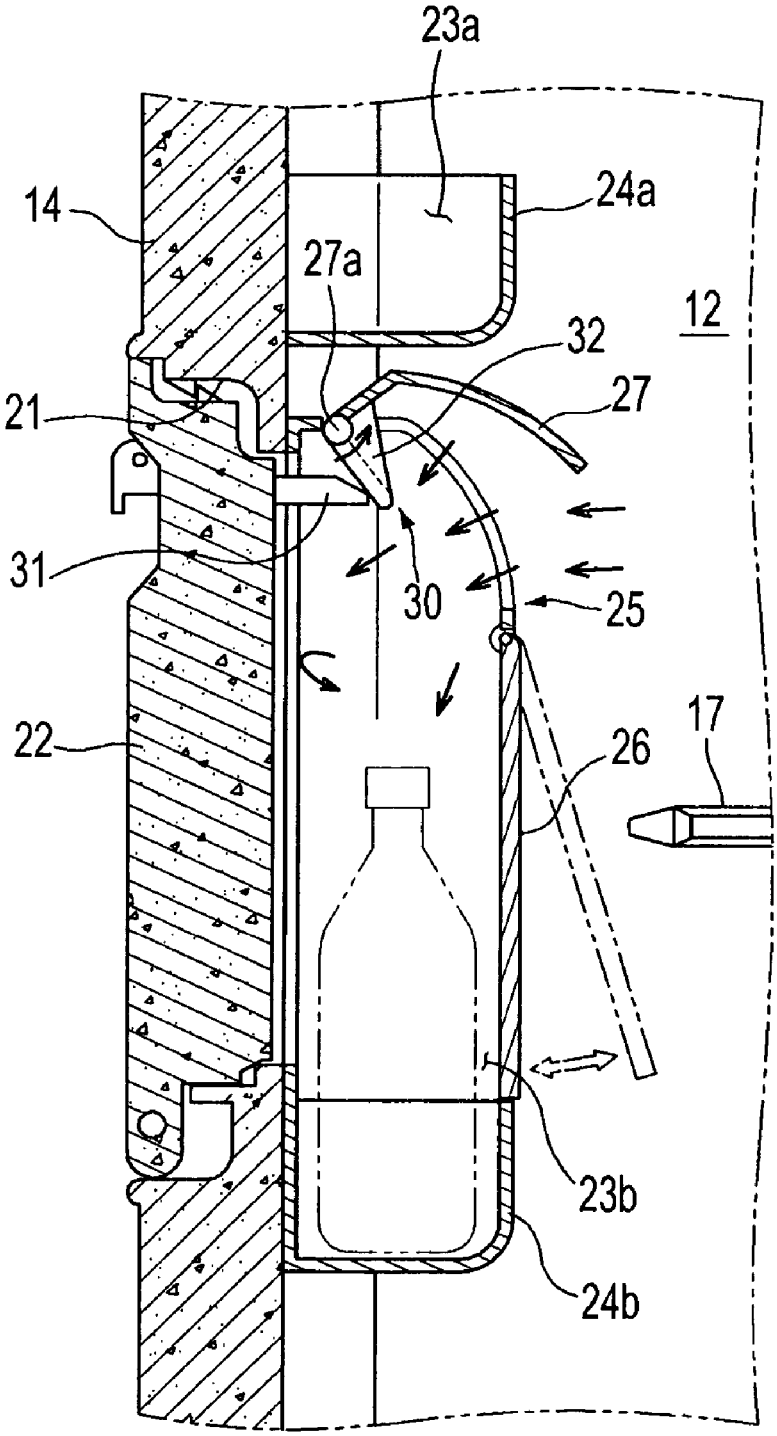
FIG. 4 is a vertical sectional view of the inner cover opening/closing device of FIG. 3, in a closed state of the auxiliary door.

FIGS. 3 and 4 show the operation of an inner cover opening/closing device 30 consistent with a first exemplary embodiment of the present invention. The inner cover opening/closing device 30 acts to close the upper second inner cover 27 when the auxiliary door 22 is opened, and to open the upper second inner cover 27 when the auxiliary door 22 is closed.

As shown in FIGS. 3 and 4, the inner cover opening/closing device 30 includes an extension 31 and a support 32. The extension 31 is provided at an inner surface of the auxiliary door 22 to extend perpendicular therefrom toward the second inner cover 27 such that it pushes and opens the second inner cover 27 when a user closes the auxiliary door 22. The support 32 extends downward from a pivot shaft 27*a* at the upper end of the second inner cover 27 by a predetermined distance to come into contact with the extension 31.

When the auxiliary door 22 is opened, as shown in FIG. 3, the extension 31 is pivotally moved outwardly, and thus is separated from the support 32 to cause the second inner cover 27 to be closed by gravity, thereby preventing the cold refrigerated air inside the refrigerating chamber 12 from leaking to the outside. When the auxiliary door 22 is closed, as shown in FIG. 4, the extension 31 of the auxiliary door 22 pushes the support 32 of the second inner cover 27 to raise and open the second inner cover 27 by pivoting, thereby allowing the cold refrigerated air inside the refrigerating chamber 12 to flow into the door storage space 23*b* and ensuring a smooth cooling of the door storage space 23*b*.

During the implementation of opening and closing operations of the second inner cover 27 as described above, the first inner cover 26 in the lower region of the door storage space 23*b* is normally closed by gravity, except for the case that it provides an access of a user to the door storage space 23*b* from the inner side of the door 14 in order to put in or take out items.

Figure 5:
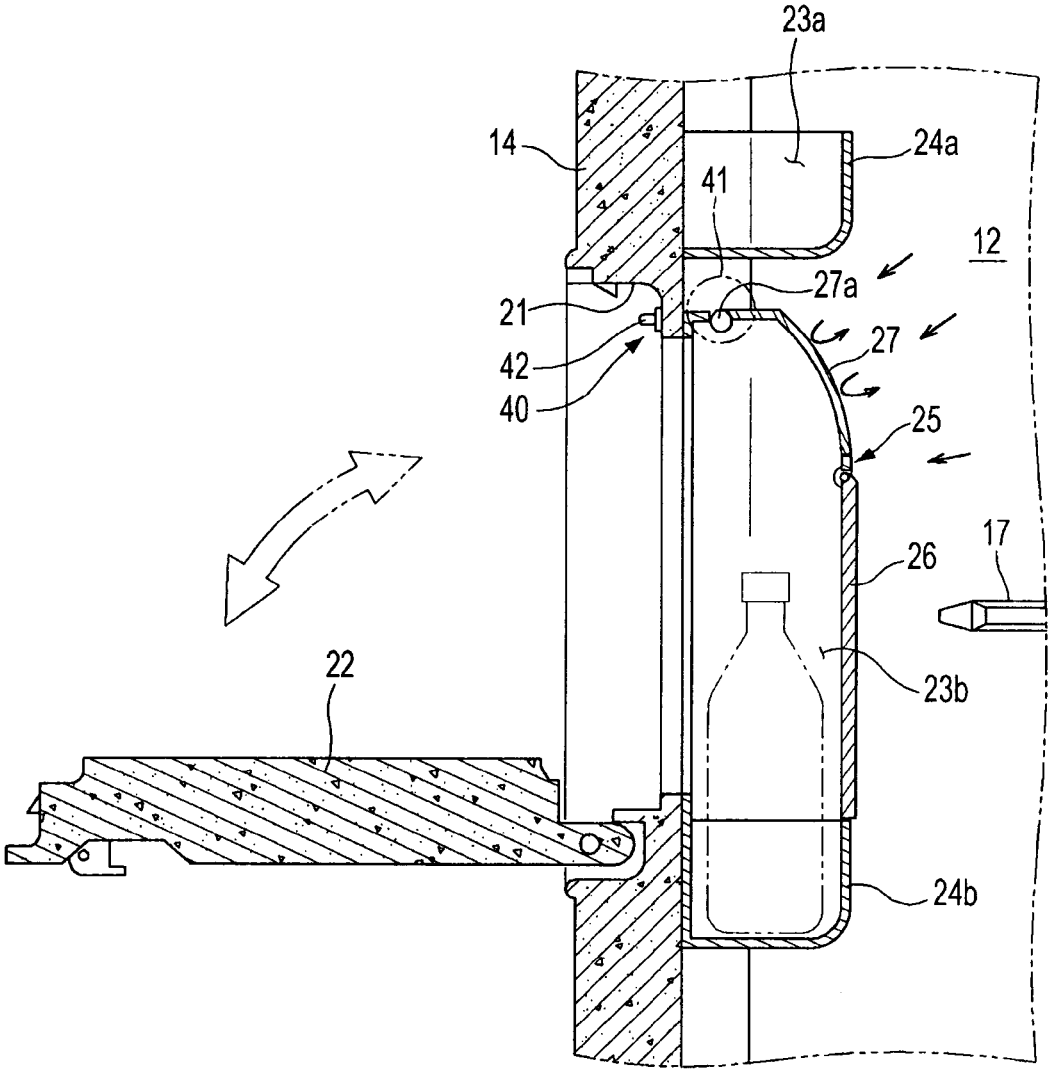
FIG. 5 is a vertical sectional view showing an inner cover opening/closing device of the refrigerator consistent with a second exemplary embodiment of the present invention, in an opened state of the auxiliary door.
Figure 6:
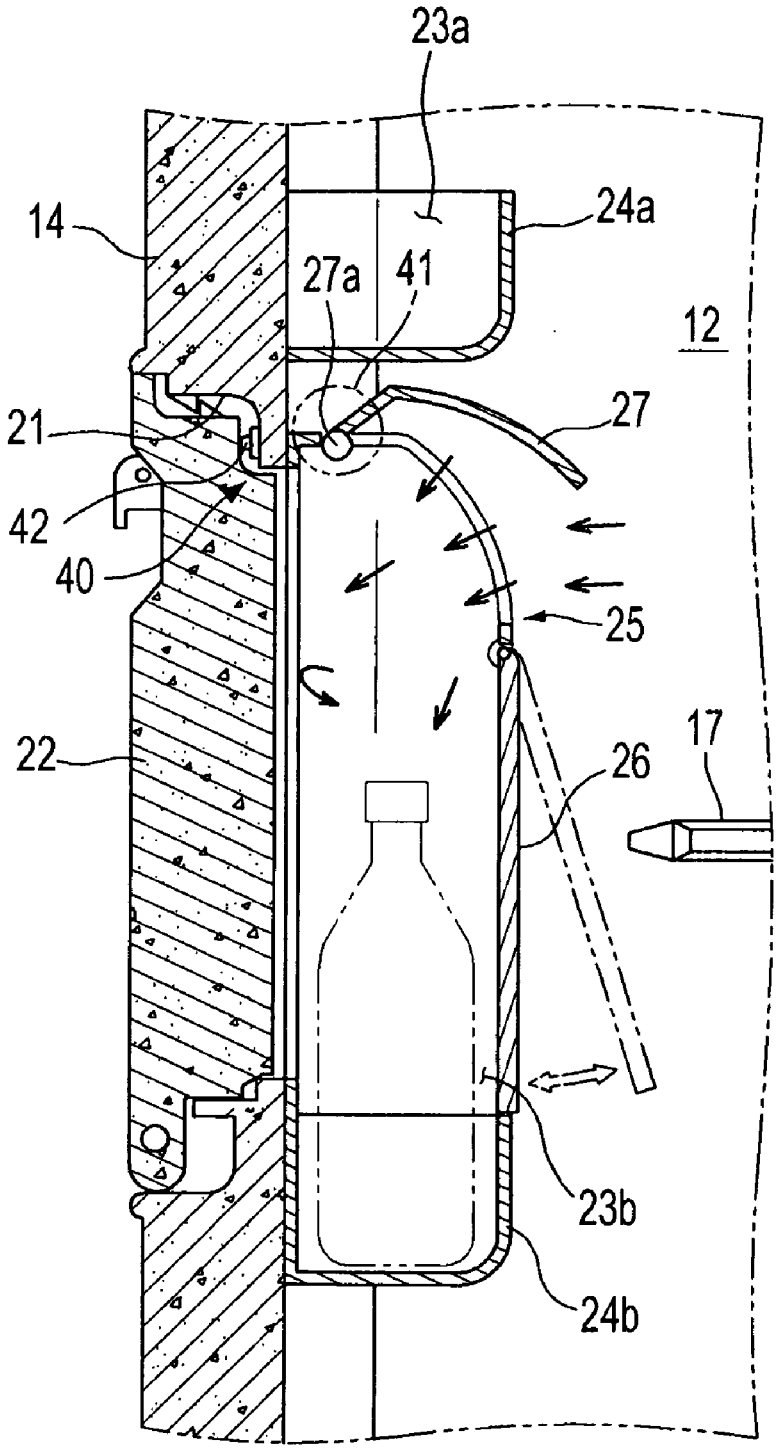
FIG. 6 is a vertical sectional view of the inner cover opening/closing device of FIG. 5, in a closed state of the auxiliary door.

FIGS. 5 and 6 show an inner cover opening/closing device 40 consistent with a second exemplary embodiment of the present invention. The inner cover opening/closing device 40, consistent with the present embodiment, includes a drive motor 41 to pivotally move the upper second inner cover 27 to open or close the second inner cover 27, and a sensor switch 42 to sense the opened or closed state of the auxiliary door 22 in order to control the opening and closing operations of the drive motor 41. The drive motor 41 is coupled to the pivot shaft 27*a* of the second inner cover 27 to pivotally move the second inner cover 27 in order to open or close the second inner cover 27. The sensor switch 42 is mounted at the top of the access opening 21 such that it is pressed by the auxiliary door 22 when a user closes the auxiliary door 22.

With the inner cover opening/closing device 40, when the auxiliary door 22 is opened, as shown in FIG. 5, the sensor switch 42 is released from its pressed state, thereby sensing the opening of the auxiliary door 22, and transmitting the sensed result to a separate control unit (not shown). Thereby, the control unit operates the drive motor 41 to close the second inner cover 27, thereby enabling prevention of a leakage of the cold refrigerated air.

When the auxiliary door 22 is closed, as shown in FIG. 6, the sensor switch 42 is pressed by the auxiliary door 22, thereby sensing the closing of the auxiliary door 22, and transmitting the sensed result to the control unit (not shown). Thereby, the control unit operates the drive motor 41 in a manner opposite to the case of FIG. 5 to open the second inner cover 27, thereby enabling a smooth cooling of the door storage space 23*b*.

As apparent from the above description, a refrigerator consistent with the present invention comprises an inner cover opening/closing device to close an inner cover when an auxiliary door is opened and to open the inner cover when the auxiliary door is closed, thereby preventing cold refrigerated air of a refrigerator storage chamber from leaking to the outside and improving a cooling efficiency of an intermediate storage space inside a refrigerator door.

Although embodiments of the present invention have been shown and described, it would be appreciated by those skilled in the art that changes may be made in this embodiment without departing from the principles and spirit of the invention, the scope of which is defined in the claims and their equivalents.

What is claimed is:

1. A refrigerator comprising:

a door to open or close a refrigerator storage chamber;

a door storage space provided at an inner side of the door;

an access opening formed through the door to allow a user to take out items stored in the door storage space from the outside of the refrigerator;

an auxiliary door mounted at an outer side of the door to open or close the access opening;

an inner cover mounted at the inner side of the door in an openable manner to separate the door storage space from the storage chamber; and an inner cover opening/closing device to close the inner cover when the auxiliary door is opened and to open the inner cover when the auxiliary door is closed.

2. The refrigerator according to claim 1, wherein the inner cover is pivotally mounted at an upper end thereof to the inner side of the door, and wherein the inner cover opening/closing device includes an extension provided at the auxiliary door to extend toward the inner cover, the extension pushing and opening the inner cover when the auxiliary door is closed while causing the inner cover to be normally closed by gravity when the auxiliary door is opened.

3. The refrigerator according to claim 2, wherein a support is provided at a pivot shaft of the inner cover to come into contact with the extension.

4. The refrigerator according to claim 1, wherein the inner cover includes a first inner cover member to open or close a lower region of the door storage space for the storage of items, and a second inner cover member to open or close an upper region of the door storage space to control a circulation of cold refrigerated air into the door storage space, the second inner cover member being opened or closed according to the closing or opening operation of the auxiliary door.

5. The refrigerator according to claim 1, wherein the inner cover opening/closing device includes a drive motor to open or close the inner cover and a sensor switch to sense whether the auxiliary door is opened or closed in order to control the opening or closing operation of the drive motor.

6. The refrigerator according to claim 5, wherein the inner cover is pivotally coupled at an upper end thereof to the inner side of the door, and the drive motor is coupled to a pivot shaft of the inner cover to open or close the inner cover.

* * * * *